US009243867B2

(12) United States Patent
Ponder

(10) Patent No.: US 9,243,867 B2
(45) Date of Patent: Jan. 26, 2016

(54) HANDS-FREE MULTI-USE LONG GUN CARRY PACK AND RELATED METHODS

(71) Applicant: Tracey Ponder, Dayton, TX (US)

(72) Inventor: Tracey Ponder, Dayton, TX (US)

(73) Assignee: Wild Bucks Outdoors, LLC, Dayton, TX (US)

( * ) Notice: Subject to any disclaimer, the term of this patent is extended or adjusted under 35 U.S.C. 154(b) by 28 days.

(21) Appl. No.: 13/691,682

(22) Filed: Nov. 30, 2012

(65) Prior Publication Data

US 2014/0151413 A1 Jun. 5, 2014

(51) Int. Cl.
*F41C 33/04* (2006.01)
*F41C 33/00* (2006.01)

(52) U.S. Cl.
CPC ..... *F41C 33/046* (2013.01); *F41C 33/007* (2013.01)

(58) Field of Classification Search
CPC ..... F41C 33/00; F41C 33/02; F41C 23/02; F41C 33/048; F41C 33/0272; A45F 5/022
USPC ..... 224/149–150, 587, 196, 199
See application file for complete search history.

(56) References Cited

U.S. PATENT DOCUMENTS 5,205,450 A * 4/1993 Derosier ..... 224/161
2001/0030210 A1* 10/2001 Donine ..... 224/160
2002/0020723 A1* 2/2002 Lindsey ..... 224/150
2002/0139825 A1* 10/2002 Madarang ..... 224/587
2004/0031827 A1* 2/2004 Haber ..... 224/160
2005/0155996 A1* 7/2005 Hiscocks ..... 224/160
2005/0184114 A1* 8/2005 Hoff et al. ..... 224/160
2007/0023467 A1* 2/2007 Spreer ..... 224/149
2008/0190972 A1* 8/2008 Gray ..... 224/160
2009/0206116 A1* 8/2009 Grant ..... 224/160
2009/0218379 A1* 9/2009 Harris et al. ..... 224/587
2009/0236378 A1* 9/2009 Crye ..... 224/148.2
2011/0042427 A1* 2/2011 Goransson-Sonnefelt ... 224/149
2013/0277408 A1* 10/2013 Kamo et al. ..... 224/639

* cited by examiner

*Primary Examiner* — Brian D Nash
(74) *Attorney, Agent, or Firm* — Honigman Miller Schwartz and Cohn LLP

(57) ABSTRACT

In general, disclosed is a multi-use and gun-protective apparatus for secure and hands-free carrying of a long gun in close proximity (in time, distance, and procedure) to a gunman carrier's gun firing position. Basically, in one embodiment, the apparatus is a reversible, open-ended, and chest-mounted bi-fold pouch configured to fold around at least part of the receiver portions (the portions of the rifle that contains the operating parts, e.g., bolt carrying group, trigger group, or magazine port) of a long gun). In operation, a long gun may be provided to the pouch so that the gun is transversely oriented with respect to torso of the gun carrier whereby the barrel of the long gun extends out of one end of the pouch while the stock of the long gun extends out of the other end of the pouch. When gun firing or deployment is necessary, the gun is located on the chest of carrier so that the barrel or stock of the gun may be gripped while the pouch is concurrently unfolded to result in the carried gun falling from the pouch into the carrier's gun firing position.

11 Claims, 12 Drawing Sheets

HANDS-FREE MULTI-USE LONG GUN CARRY PACK AND RELATED METHODS

CROSS-REFERENCE TO RELATED APPLICATIONS

This application claims the benefit and priority of U.S. Prov. Pat. App. Ser. No. 61/565,731 (filed Dec. 1, 2011) entitled "Multi-use long gun carry pack."

STATEMENT REGARDING FEDERALLY SPONSORED RESEARCH OR DEVELOPMENT

Not applicable.

BACKGROUND OF THE INVENTION

1. Field of Invention

This specification discloses subject matter in the field of hands-free and multiple use carrying packs for long-guns. In particular, the disclosed subject matter is in the field of hands-free apparatus for releasably securing a long gun to a person.

2. Background of the Invention

Long guns are an elongated class of firearms generally designed to be discharged by a gunman with an outstretched arm supporting the barrel of the gun while the gun stock is braced against his or her shoulder. Long guns have many practical uses, particularly in military and sportsman arts. Despite this utility, long guns are usually heavy and lengthy whereby manually carrying such guns can be difficult and tiring. Furthermore, manually carrying a gun occupies the gunman's hands and arms so that multi-tasking by the carrier is limited.

Many apparatus exist which allow hands-free carrying of a long gun on the back of a gunman. While loading a long gun on the back of the gunman eases the gunman's burdens of manually carrying the gun, apparatus for back mounting long guns are not entirely suitable for all situations because, the gun is hard to reach and far (in time, distance, and procedure) from a gunman's fire-ready position.

Other apparatus for assisting a gunman's carrying of a long gun also exist, but such apparatus are either uncomfortable for the gunman or expose the gun and its components (e.g., sighting elements) to damage. For example, sling type apparatus exists for supporting a long gun over a shoulder of the gunman, but such apparatus: focus the weight of the long gun on a single extremity (e.g. a single arm or shoulder) so that carrying the gun becomes uncomfortable; leave the gun dangling on the shoulder so that the gun may either be dropped or hit against items; and place the gun at a location that is far (in time, distance, and procedure) from the gunman's fire-ready position.

In view of the foregoing, there is a need for gun-protective multi-use apparatus for secure and hands-free carrying of a long gun in close proximity (in time, distance, and procedure) to a firing position of a gunman carrier.

SUMMARY OF THE INVENTION

In view of the foregoing, it is an object of the present specification to describe a multi-use and gun-protective apparatus for secure and hands-free carrying of a long gun in close proximity (in time, distance, and procedure) to a gunman carrier's gun firing position. In one embodiment, the apparatus is a reversible, open-ended, and chest-mounted bi-fold pouch for securely carrying of a gun in a transverse orientation (whether perpendicular or oblique) with respect to the carrier's torso. Suitably, the apparatus may be reversible in that the gun may be oriented with its barrel or stock on either side of the carrier to accommodate left or right handed gunmen. Suitably, the pouch may be provided to a vest, halter, or any other outfit for the torso of a person. In another embodiment, such outfits may be provided with one or more pockets for carrying gun accessories. Other objectives will be readily apparent to those of skill in the art after reading this disclosure.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed apparatus, and therefore, are not to be considered limiting of the scope of the disclosed subject matter, for the disclosed apparatus may admit to other equally effective embodiments that will be appreciated by those reasonably skilled in the relevant arts. Also, figures are not necessarily made to scale.

DETAILED DESCRIPTION OF PREFERRED EMBODIMENTS

In general, disclosed is a multi-use and gun-protective apparatus for secure and hands-free carrying of a long gun in close proximity (in time, distance, and procedure) to a gunman carrier's gun firing position. Basically, in one embodiment, the apparatus is a reversible, open-ended, and chest-mounted bi-fold pouch configured to fold around at least part of the receiver portions (the portions of the rifle that contains the operating parts, e.g., bolt carrying group, trigger group, or magazine port) of a long gun. In operation, a long gun may be provided to the pouch so that the gun is transversely oriented with respect to torso of the gun carrier whereby the barrel of the long gun extends out of one end of the pouch while the stock of the long gun extends out of the other end of the pouch. When gun firing or deployment is necessary, the gun is located on the chest of carrier so that the barrel or stock of the gun may be gripped while the pouch is concurrently unfolded to result in the carried gun falling from the pouch into the carrier's gun firing position. The more specific details of the disclosed apparatus and related methods are further disclosed with reference to the attached figures.

Figure 1:
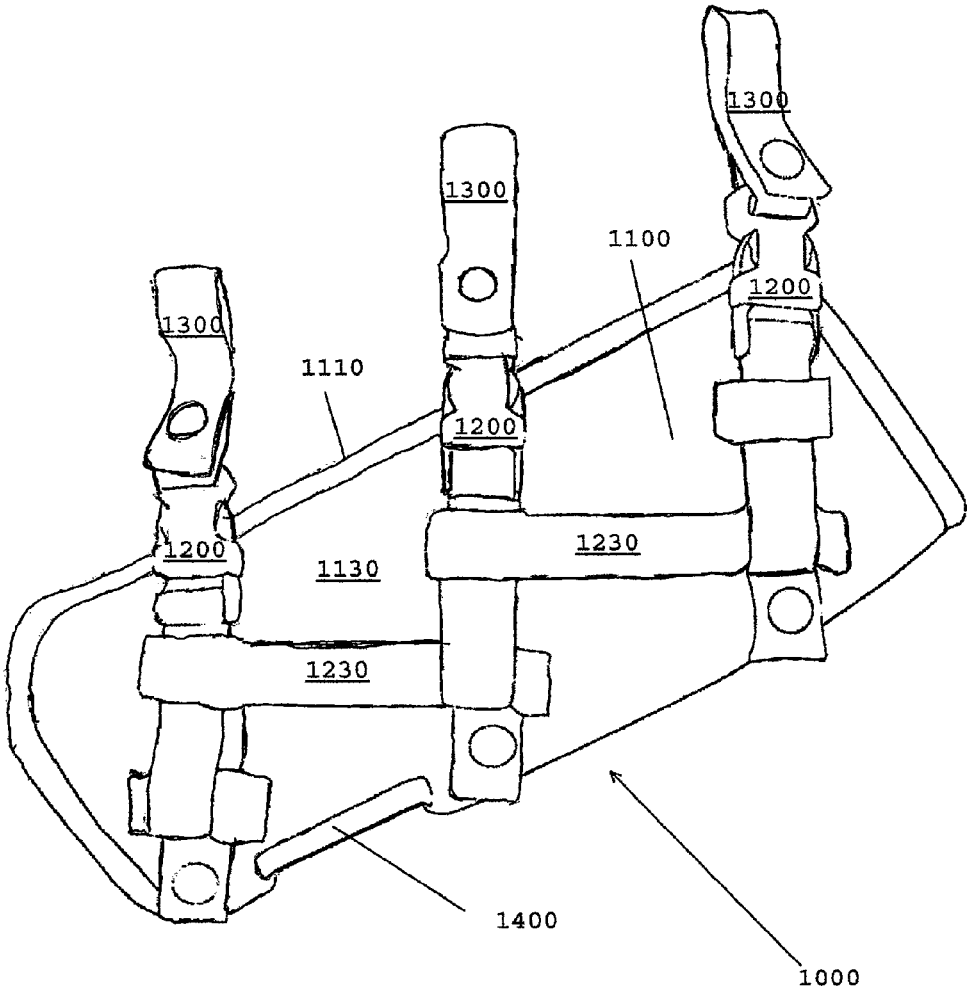
FIG. 1 is a front view of a closed embodiment of a multi-use and gun-protective apparatus 1000 for secure and hands-free carrying of a long gun in close proximity (in time, distance, and procedure) to a gunman carrier's gun firing position.
Figure 2:
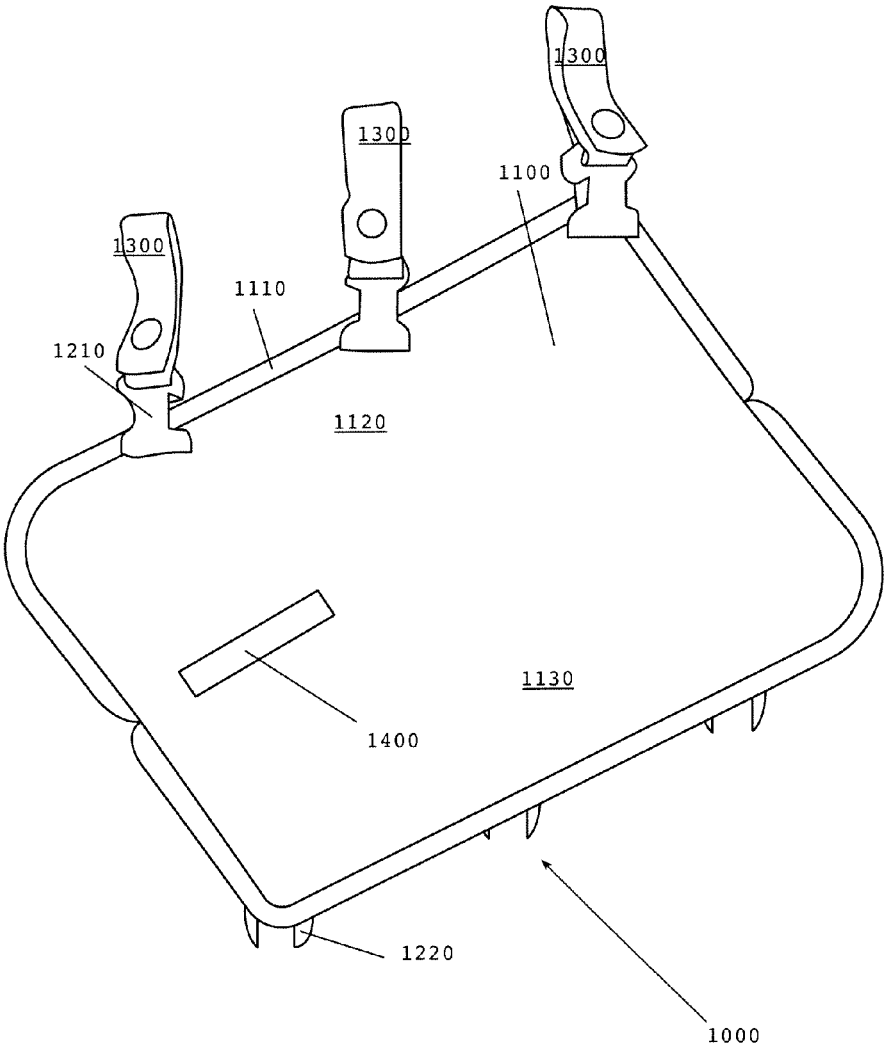
FIG. 2 is a front view of an open embodiment of the apparatus of FIG. 1.

FIGS. 1 and 2 respectively show closed and open front views of an apparatus 1000 for carrying a long gun. Referring first to FIG. 1, the closed apparatus 1000 is preferably defined by a bi-folded pouch 1100 with three closed side-release clasps or buckle fasteners 1200 proportionately spaced along the disjointed 1110 side (i.e., the side of the apparatus 1000 that is opposite of the folded side). of the apparatus 1000. The fasteners 1200 may be of any type (e.g., snaps, buttons, or buckles), but side-release clasps or buckle fasteners (e.g., those fasteners disclosed by U.S. Pat. No. 5,546,642 (issued Aug. 20, 1996)) are preferable. Referring next to FIG. 2, the open apparatus is preferably defined by the unfolded bi-fold-pouch 1100 wherein the inside of the jointed rear and forward flaps 1120, 1130 of the bi-fold pouch is exposed. Suitably, the female portion 1210 of the fasteners 1200 are positioned along the disjointed side of the rear flap 1120 while the corresponding male portion 1220 of the fasteners 1200 are preferably positioned on the external side of the forward flap 1130. Referring to both FIGS. 1 and 2, the male portion 1220 of the fasteners 1200, in one embodiment, are secured to the external side of the forward flap 1130 with a vertically load distribution (e.g., the male portions 1220 are secured to the flap near the jointed side and near the disjointed side of the front flap 1130). Still referring to the figures, male portions 1220 of the fasteners 1200 are suitably provided with length supports 1230 so that bunching of the bi-fold pouch is restricted. As shown in the same figures, the apparatus 1000 features a snap-loops 1300 corresponding to the fasteners 1200 for, as discussed below, securing the apparatus 1000 to other items e.g., according to the standards for MOLLE (Modular Lightweight Load-carrying Equipment). Also discussed below, the bi-fold pouch 1100 may optionally feature an aperture 1400 for accommodating various projections in the receiving portion of a long gun (e.g., a trigger guard).

It should be noted that, even though the apparatus has been shown with three fasteners 1200 and three corresponding snap loops 1300, any number of fasteners and snap loops may be used depending on the size and type of gun carried in the apparatus 1000. For example for shorter guns, the length of the apparatus 1000 and number of fasteners and loops may be reduced. Conversely the length and number of fasteners and loops may be increased for heavier or longer firearms. It should also be noted that, the size, number and positions of aperture 1400 may be modified for accommodating various projections from the receiving portions of a fire arm (e.g., see FIGS. 10A and 10B for adaptations of the apertures for magazine clips and the like).

Figure 3:
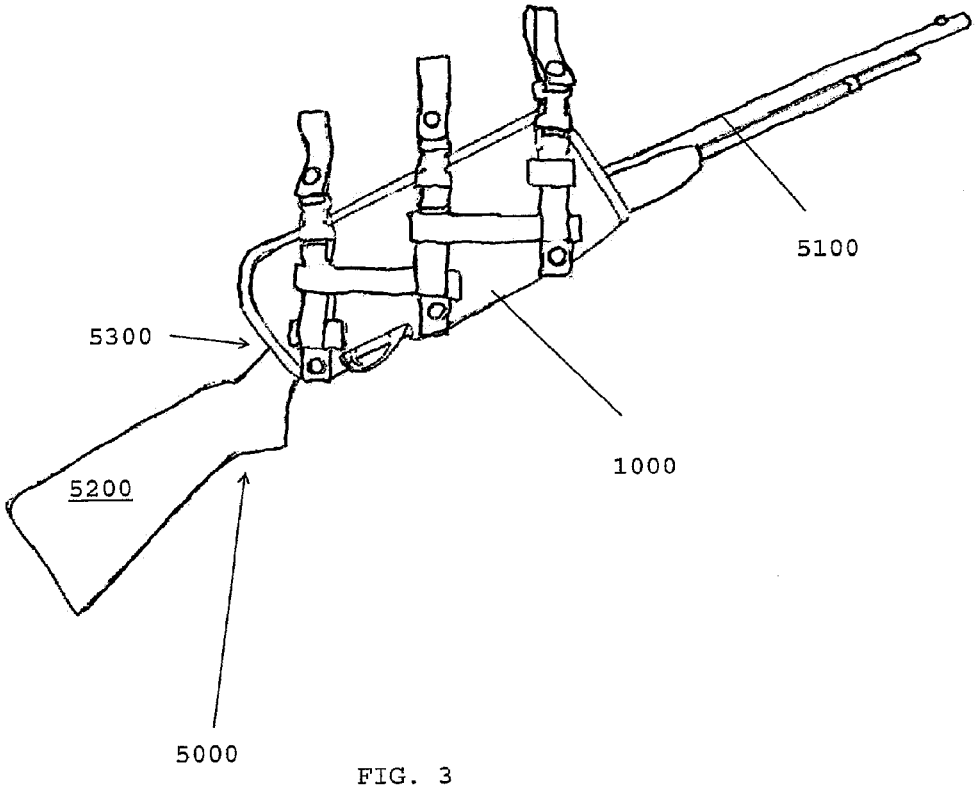
FIG. 3 is a front view of the apparatus 1000 of FIGS. 1 and 2 with a long-gun 5000 provided thereto.

FIG. 3 shows a gun 5000 provided to the apparatus 1000. As shown, the apparatus 1000 is a reversible, open-ended, bi-fold pouch 1100 configured to fold around at least part of the receiver portions 5300 of a long gun 5000. In operation, a receiver portion 5300 of a long gun 5000 may be provided to the bi-fold pouch 1100 so that the barrel 5100 of the gun extends out of one end of the pouch 1100 while the stock 5200 of the long gun extends out of the other end of the pouch 1100.

Figure 4:
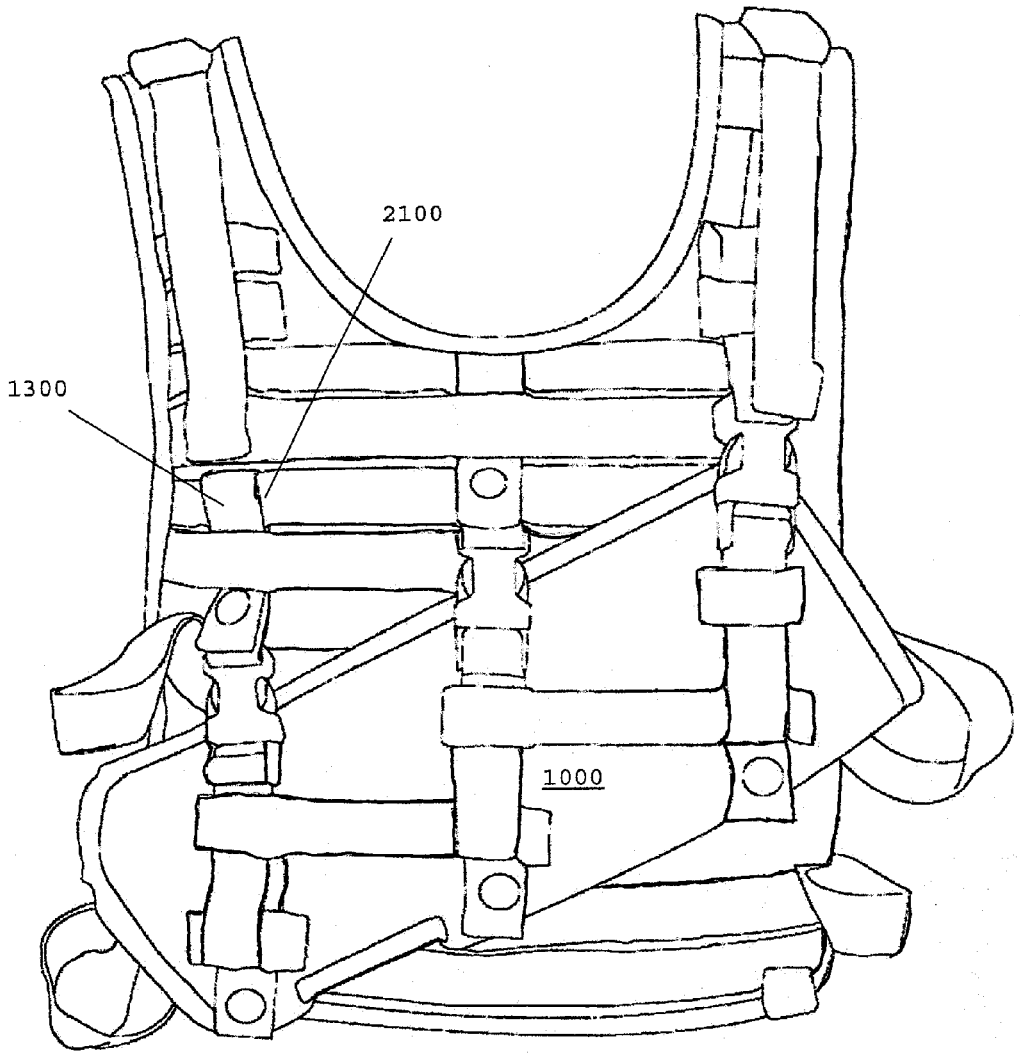
FIG. 4 is a front view of a MOLLE vest 2000 with the apparatus 1000 attached thereto.
Figure 5:
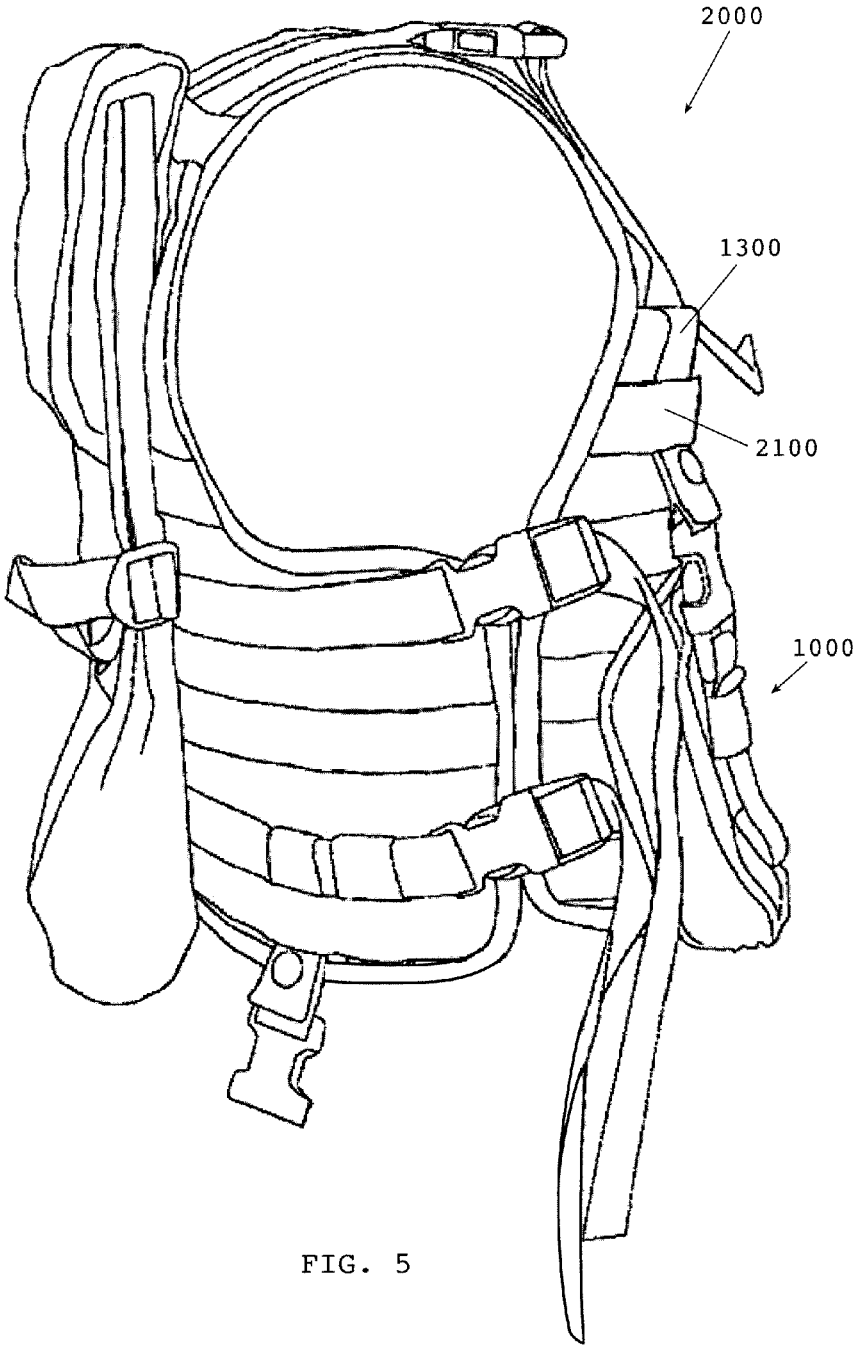
FIG. 5 is a right side view of the vest 2000 of FIG. 5.
Figure 6:
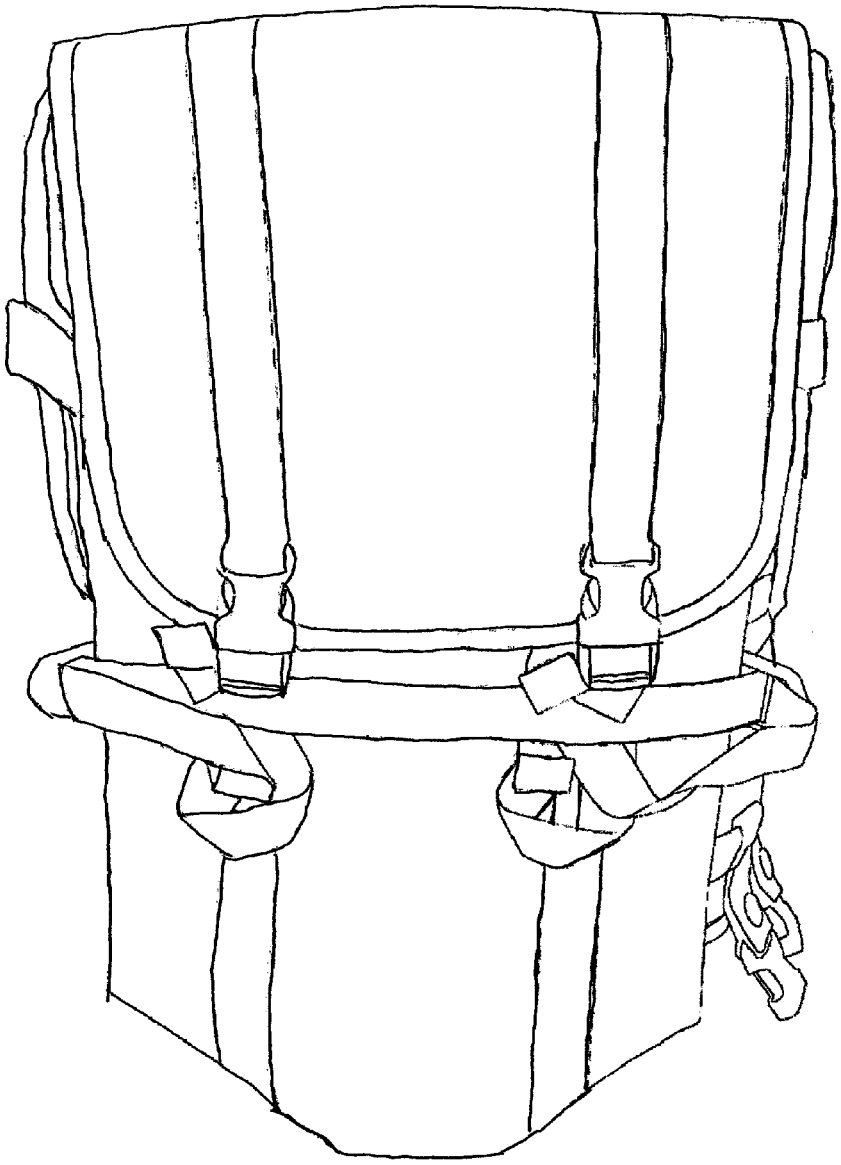
FIG. 6 is a back view of the vest 2000 of FIGS. 5 and 6.
Figure 11:
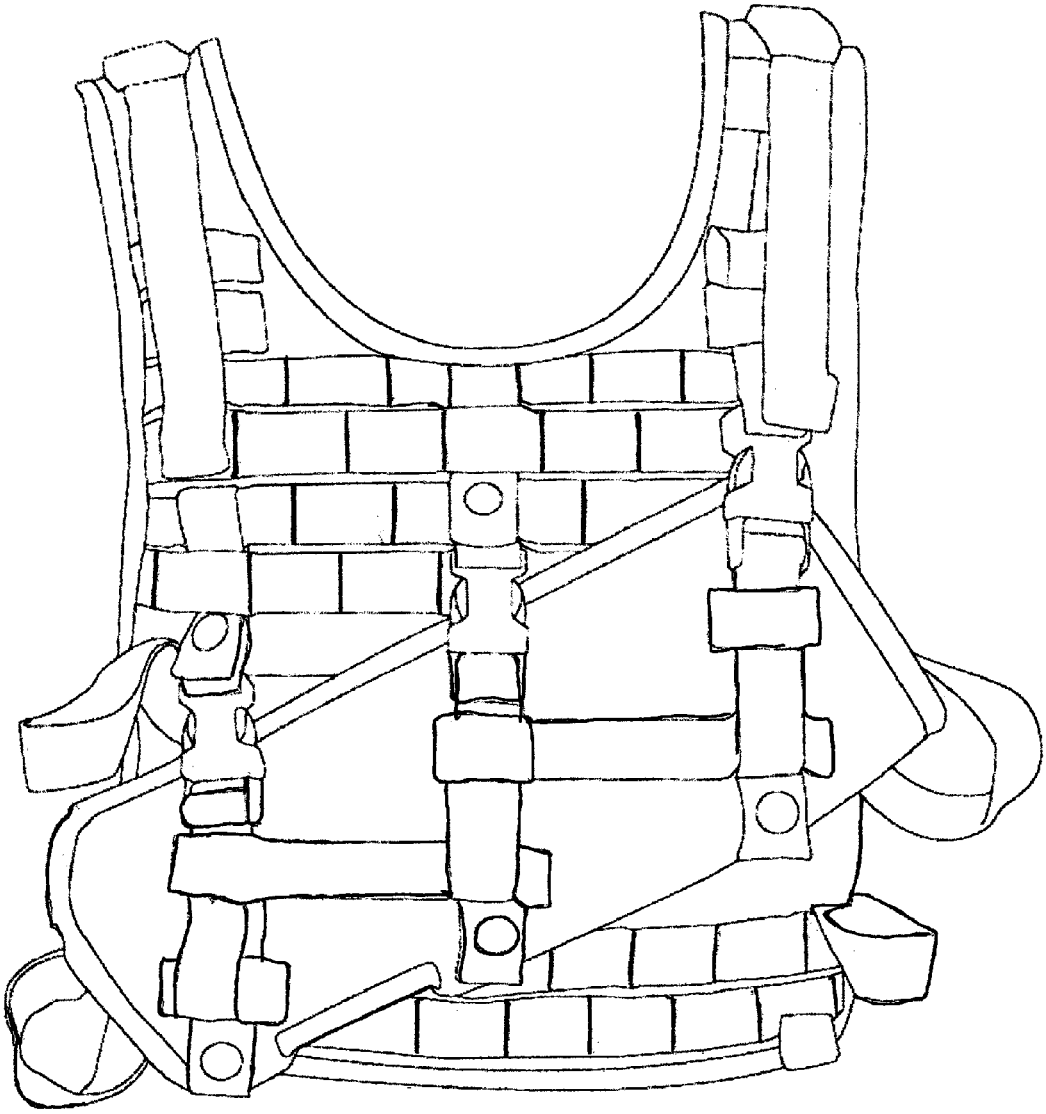

FIGS. 4 through 6 illustrate respectively front, right side, and back views of a vest 2000 for supporting the apparatus 1000 depicted in connection with FIGS. 1 through 3. As shown, the vest 2000 is a standard issue MOLLE vest with various rows and columns of loops 2100 disposed thereon. Referring to FIG. 4, the apparatus 1000 may be provided to the vest via interlinking the loops 2100 of the vest 2000 with the snap loops 1300 of the apparatus 1000. Practically, a long gun (see, e.g., FIG. 3) may be provided to the apparatus 1000 so that the gun is transversely oriented with respect to torso or vest 2000 of the gun carrier whereby the barrel of the long gun 5000 extends out of one end of the pouch while the stock of the long gun extends out of the other end of the pouch. In one embodiment the position and transverse orientation of the apparatus 1000 may be customized to a carrier via adjusting the interlinking of the snap loops 1300 to various rows and columns of loops 2100 on the vest. Referring to FIG. 11, the rows and columns of the loops 2100 on the vest may be staggered so that the apparatus 1000 may be further restricted from bunching.

Figure 7A:
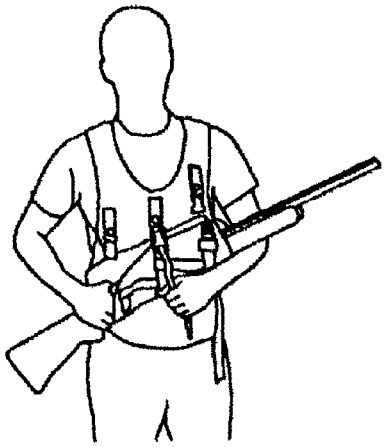
FIGS. 7A through 7D illustrate a preferred mode of operation for the disclosed apparatus 1000.
Figure 7B:
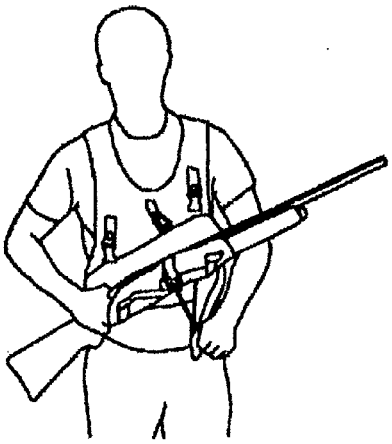
Figure 7C:
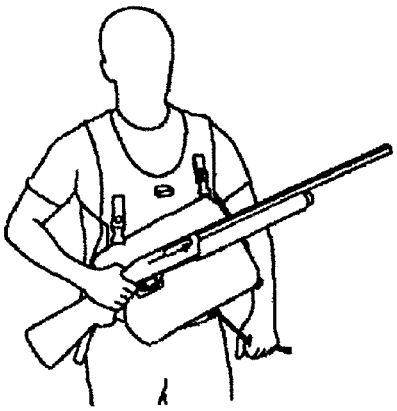
Figure 7D:
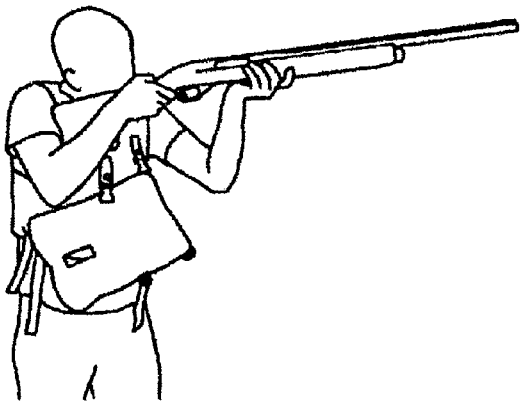

FIG. 7A through 7D illustrate a preferred mode of operation of the apparatus 100. As alluded to above and referring to the figures, the apparatus 1000 may be used for hands-free carrying of a long gun 5000. Suitably, whenever gun 5000 firing or deployment is necessary, the barrel or stock of the gun 5000 may be gripped while the pouch 1100 is concurrently unfolded so that the carried gun may fall from the pouch into the carrier's gun firing position (follow, e.g., from FIG. 7A through 7D). Preferably, quick unfolding of the apparatus accomplished either by a pull-release mechanism (e.g. fasteners purchased from National Molding, product number 10025, entitled 1" Quick release buckle) of one or more of the fasteners 1200 or by one or more of the female portions 1210 of the fasteners 1200 being attached to the pouch 1200 by a releasable attachment means. In one embodiment, the releasable fastening means may be buttons, snaps, hook and loop fasteners (like Velcro®) or the like. The release may operate in the fashion of a ripcord to expose the firearm. Referring to FIGS. 7D through 7A (in reverse alphanumerical order) a gun may be provided to the apparatus 1000 via positioning the gun so that a receiving portion is inside an open pouch 1000, folding the pouch over the gun, and fastening the fasteners 1200. In a preferred embodiment, a gun 5000 is carried in the apparatus 1000 with only the center fastener 1200 closed, wherein the center fastener 1200 is a quick-release buckle so that pulling down on the center fastener 1200 accomplishes unfolding of the apparatus 1000 and deployment of the long gun 5000.

Figure 10A:
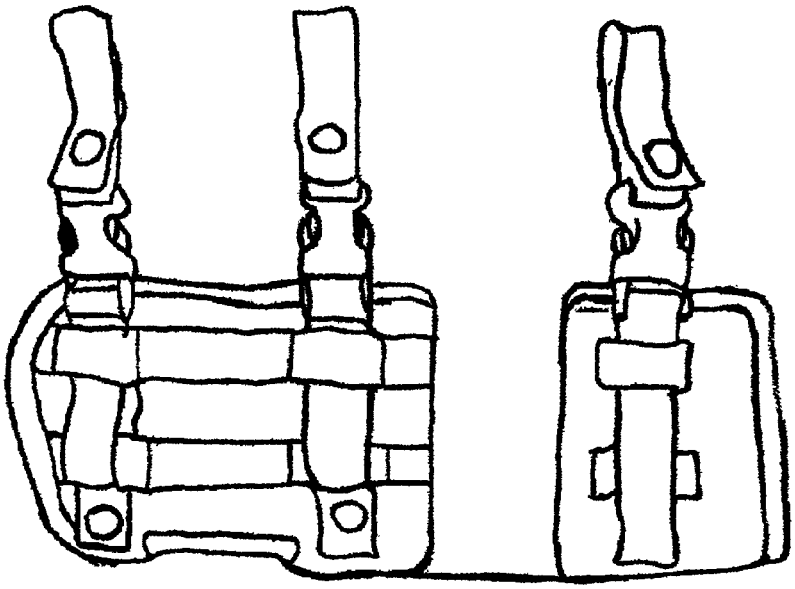
FIGS. 10A and 10B show alternative embodiments of the apparatus 1000; and, FIG. 11 is a front view of an alternate embodiment of a vest 2000.
Figure 10B:
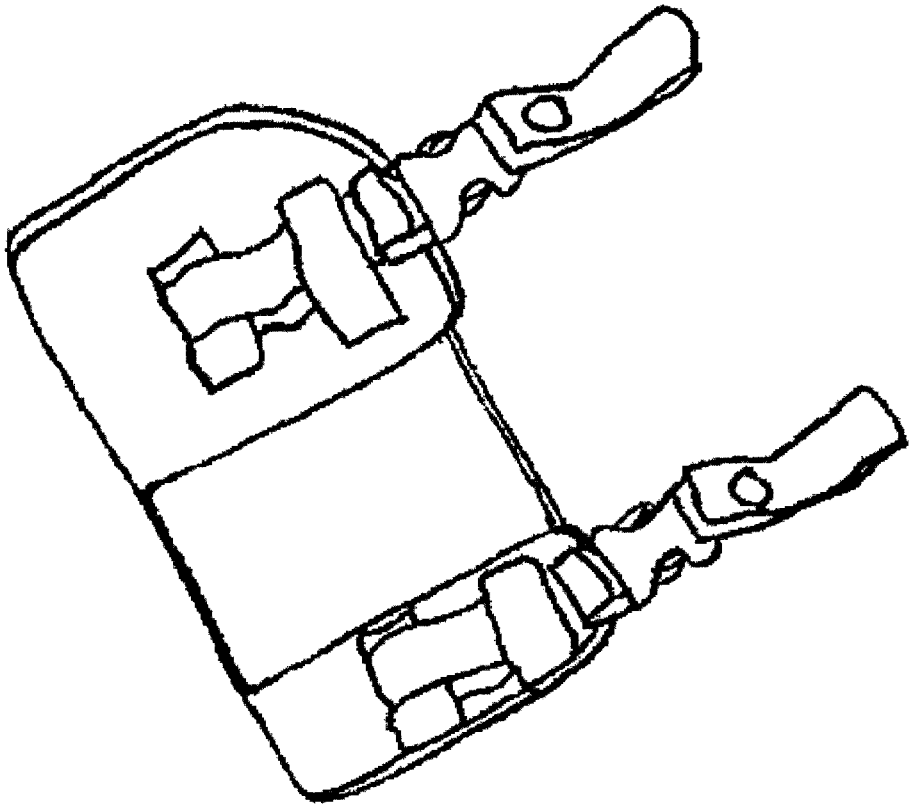

As alluded to above, the apparatus 1000 may be adapted to accommodate various types of long guns. For example, FIG. 10A depicts an apparatus wherein the forward flap 1300 is segmented so that a long gun with a magazine clip may be provided between the forward flap segments. For another example, FIG. 10B depicts an apparatus that has been shorted and segmented to accommodate an M-16 or other assault rifle. Other adaptations for various types of long guns will be appreciated by those of skill in the art after reading this disclosure.

Figure 8:
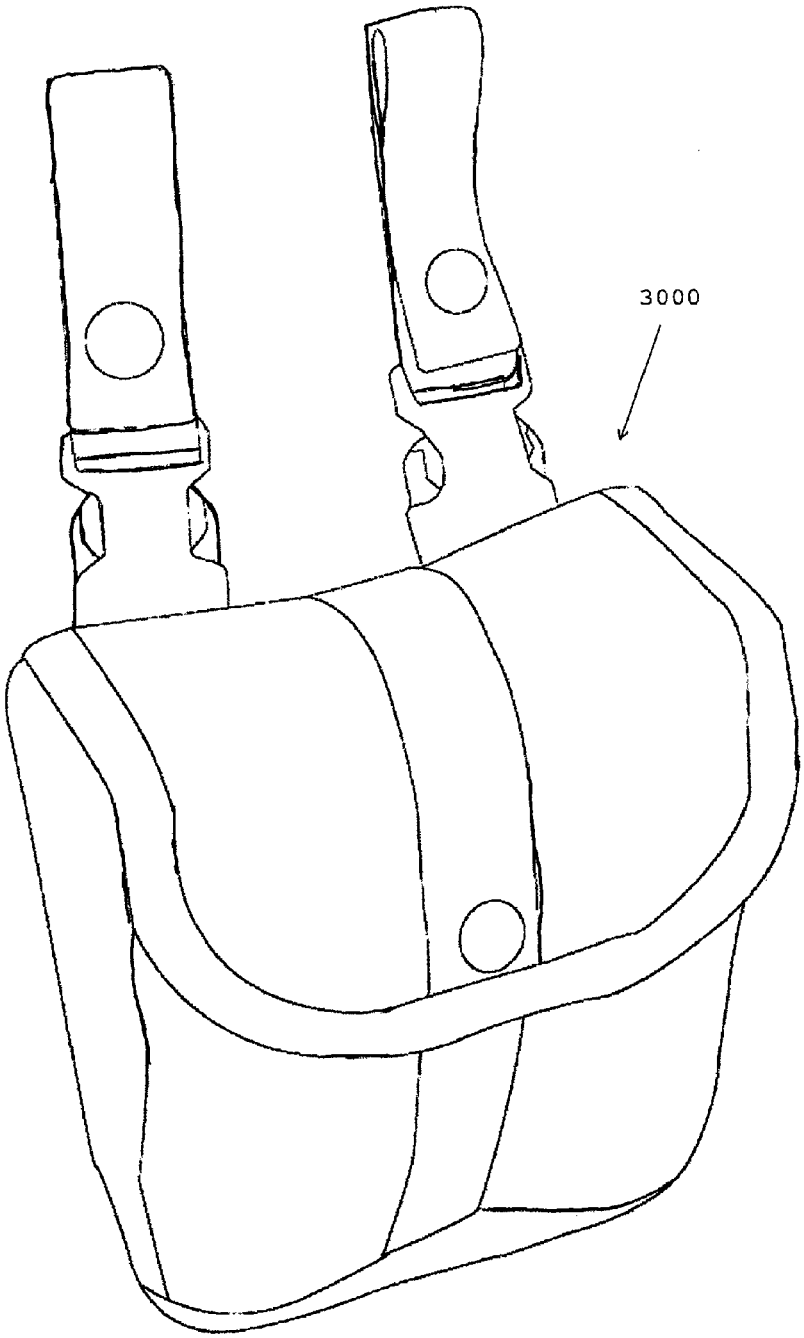
FIG. 8 is a perspective view of a basic embodiment of a pocket 3000 for carrying gun accessories.
Figure 9:
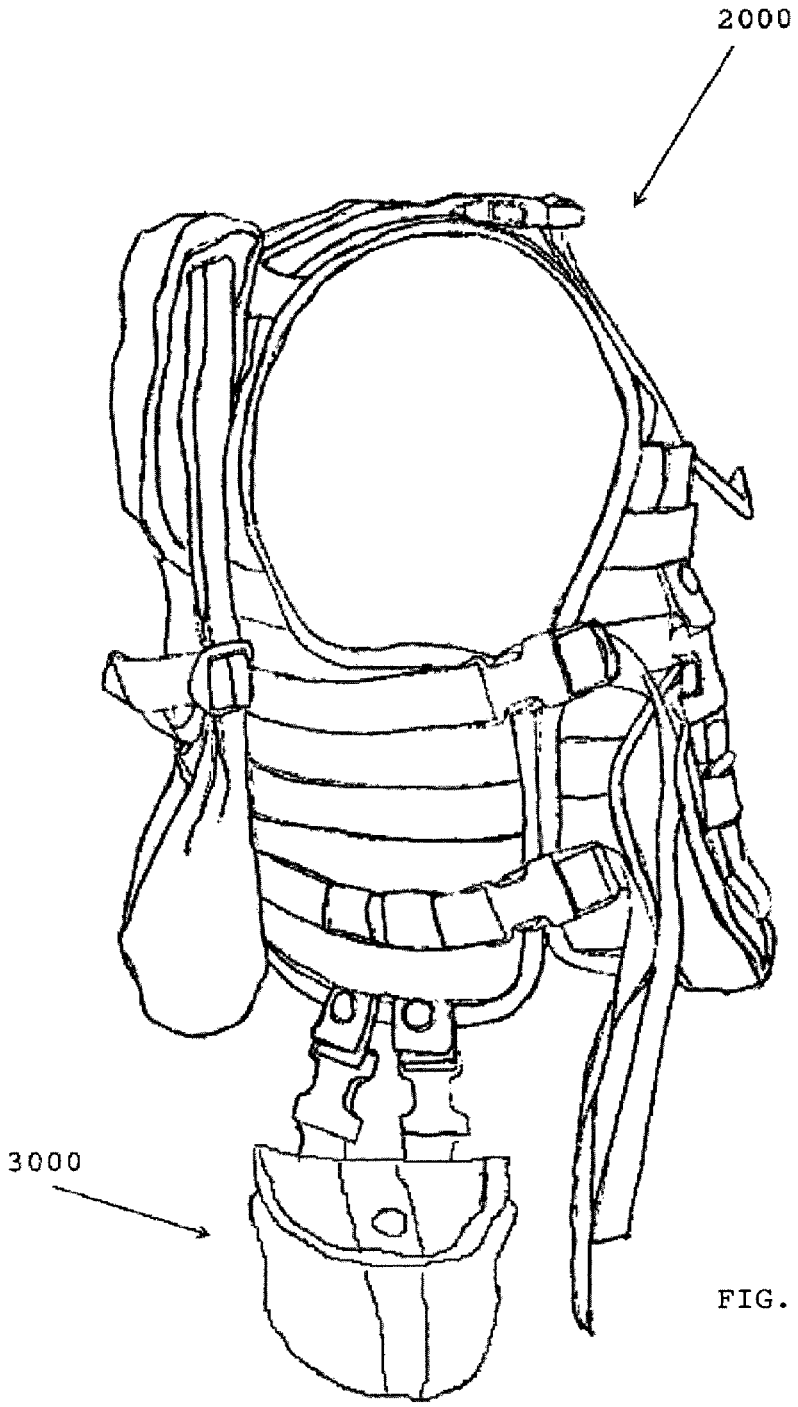
FIG. 9 is a side view of the vest 2000 with the pocket 3000 of FIG. 8 attached thereto.

FIGS. 8 and 9 depict a gun accessory pocket 3000. Suitably the pocket is water proof and configured for attachment to the vest 2000 as shown in FIG. 9. In one embodiment, the pocket 3000 is attached to the side of the vest.

It should be noted that FIGS. 1 through 11 and the associated description are of illustrative importance only. In other words, the depictions and descriptions of the present disclosure should not be construed as limiting of the subject matter in this application. Additional modifications may become apparent to one skilled in the art after reading this disclosure. For example, instead of a vest, the apparatus 1000 may be provided to a halter or other outfit for the torso of a person. For another example, instead of a snap-loop for attaching the apparatus 1000 according to MOLLE, the apparatus may be attached directly to the vest or other outfit by sewing, adhesive or other attaching mechanisms. Finally, the apparatus may suitably adapted to other weapons, like, for example, a bow or cross bow.

I claim:

1. An apparatus, comprising:

a bi-fold pouch formed by a rear flap and a forward flap, wherein the rear flap is demarcated from the forward flap by a fold seam; and at least one fastener secured to the bi-fold pouch, wherein the at least one fastener includes a female portion and a male portion, wherein one of the female portion and the male portion is secured to a disjointed side of the rear flap, wherein the other of the female portion and the male portion is secured to an external side of the forward flap;

wherein the at least one fastener is arranged in one of a connected state and a disconnected state, wherein the connected state is defined by the male portion connected to the female portion such that the forward flap is foldably-secured to and arranged substantially adjacent the rear flap, wherein the disconnected state is defined by the male portion being disconnected from the female portion such that the forward flap is foldably-deployed away from and not arranged substantially adjacent the rear flap.

2. The apparatus of claim 1 further comprising:

an aperture disposed along the fold seam, wherein the aperture is configured to accommodate a receiver of a firearm.

3. The apparatus of claim 1, wherein the at least one fastener includes two or more fasteners.

4. The apparatus of claim 1, further comprising:

at least one snap loop connected to and extending from the at least one fastener, wherein the at least one snap loop is configured for securing the bi-fold pouch to a vest.

5. The apparatus of claim 4 wherein said vest further includes a gun accessory pocket.

6. The apparatus of claim 1, wherein the forward flap is segmented to accommodate a high-capacity magazine for a rifle to be interfaced with the bi-fold pouch.

7. The apparatus of claim 1, wherein one of the female portion and the male portion of the at least one fastener is fixed to the bi-fold pouch in a manner whereby a mating edge of the female portion and the male portion is arranged in a non-orthogonal manner with respect to a perimeter edge of the rear flap or the forward flap such that when the at least one fastener is arranged in the connected state, the bi-fold pouch is transversely or diagonally slung across a torso of a user.

8. The apparatus of claim 1, further comprising:

at least one length support extending from the male portion of the at least one fastener, wherein the at least one length support that extends across the forward flap for restricting the forward flap to bunch relative the rear flap when the at least one fastener is arranged in the connected state.

9. A method, comprising the steps of:

securing at least one fastener that includes a female portion and a male portion to a bi-fold pouch including a rear flap and a forward flap such that one of the female portion and the male portion is secured to a disjointed side of the rear flap and the other of the female portion and the male portion is secured to an external side of the forward flap;

arranging the at least one fastener in one of a connected state and a disconnected state whereby the connected state includes:

connecting the male portion to the female portion such that the forward flap is foldably-secured to and arranged substantially adjacent the rear flap, wherein the disconnected state includes:

disconnecting the male portion from the female portion such that the forward flap is foldably-deployed away from and is not arranged substantially adjacent the rear flap.

10. The method of claim 9 further comprising the steps of:

securing at least one snap loop to the at least one fastener; and removably-securing the at least one snap loop to a vest.

11. The method of claim 9, further comprising the step of:

extending at least one length support from the male portion of the at least one fastener; and arranging the at least one length support across the forward flap for restricting the forward flap to bunch relative the rear flap when the at least one fastener is arranged in the connected state.

* * * * *